US006523929B2

(12) United States Patent
Kan et al.

(10) Patent No.: US 6,523,929 B2
(45) Date of Patent: Feb. 25, 2003

(54) IMAGE FORMING APPARATUS

(75) Inventors: Shoichi Kan, Yokohama (JP); Yasutsugu Saijo, Tokyo (JP); Masahito Yoshida, Shiki (JP); Nozomu Nishiberi, Yokohama (JP); Masaya Shinmachi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/789,613

(22) Filed: Feb. 22, 2001

(65) Prior Publication Data

US 2001/0017635 A1 Aug. 30, 2001

(30) Foreign Application Priority Data

Feb. 24, 2000 (JP) ..... 2000-048332

(51) Int. Cl.[7] ..... B41J 2/165

(52) U.S. Cl. ..... 347/22; 347/23; 347/29; 347/30

(58) Field of Search ..... 347/22, 23, 29, 347/30, 32, 33, 37, 101, 104

(56) References Cited

U.S. PATENT DOCUMENTS

| | | | | |
|---|---|---|---|---|
| 4,825,231 A | * | 4/1989 | Nozaki | 347/29 |
| 5,831,644 A | * | 11/1998 | Kato | 347/22 |
| 5,883,645 A | * | 3/1999 | Ikado et al. | 347/30 |

FOREIGN PATENT DOCUMENTS

| | | | |
|---|---|---|---|
| EP | 0 785 084 A2 | * | 7/1997 |
| EP | 0 916 508 | | 5/1999 |
| JP | 11-138782 | | 5/1999 |
| JP | 2000-135794 | | 5/2000 |
| JP | 2001-58731 | | 3/2001 |
| JP | 2001-58742 | | 3/2001 |

OTHER PUBLICATIONS

09/789,615 Kan, Shoichi, "Image Forming Apparatus", Feb. 22, 2001 Pending.

* cited by examiner

*Primary Examiner*—Shih-wen Hsieh
(74) *Attorney, Agent, or Firm*—Fitzpatrick, Cella, Harper & Scinto

(57) ABSTRACT

According to an image forming apparatus, a simple arrangement is used to switch the transmission of drive forces, produced by drive sources that are used in common by multiple drive mechanisms, without depending on the movement of a carriage, for example. The drive force produced by a line feed (LF) motor to drive feed rollers is transmitted to a pump cam in a recovery system via a pendulum drive force transmission mechanism, which is provided at one end close to the feed rollers. And the drive force produced by another motor to drive paper supply rollers is transmitted via the same pendulum drive force transmission mechanism to the paper supply rollers, or to a blade holder and a cap holder in the recovery system. Therefore, the transmission of the drive forces can be switched by controlling the rotational directions of the motors.

7 Claims, 11 Drawing Sheets

IMAGE FORMING APPARATUS

BACKGROUND OF THE INVENTION

1. Field of the Invention

The present invention relates to an image forming apparatus for forming characters and images on a recording medium, such as a recording sheet, as it is being fed into the apparatus, and relates in particular to an image forming apparatus wherein a drive source is employed in common by multiple mechanisms, such as a recording medium feeding mechanism and an ink-jet head recovery mechanism for image forming.

2. Related Background Art

As the use in offices of personal computers, word processors and facsimile machines has become common, a variety of different image forming apparatuses have been produced and utilized to support automated office machines. Above all, since image forming apparatuses such as ink-jet printers, which form characters and images by ejecting ink onto recording media, provide superior balance among image quality, printing speeds, apparatus sizes and prices, and can easily produce colored images, image forming apparatuses have become especially popular and are presently employed in many fields.

These types of image forming apparatuses, specifically, ink-jet printers, generally include recovery mechanisms for removing viscous ink or dust attached to discharging orifices of ink-jet heads, and for thus maintaining a stable ink ejection function.

A well known recovery mechanism is a capping mechanism that, when printing is not in progress, uses a cap to cover the discharging orifice face of an ink jet head and to prevent ink from drying or evaporating, and that uses either a wiping mechanism, for which a blade is employed to wipe the discharging orifice face and remove attached ink, or a suction mechanism, for which suction is used to remove ink, through a cap, from the discharging orifices and from the surfaces in their vicinities. It should be noted that in this case the suction mechanism uses a pump to establish a negative pressure inside a cap covering the discharging orifice face and remove ink from the discharging orifices.

For a common image forming apparatus, a mechanism provided for supplying and feeding a recording medium, comprising an automatic paper supply mechanism, stores multiple recording media, such as recording sheets, and separates and separately supplies individual recording media; and a feeding mechanism, located downstream, synchronizes the feeding of the individual recording media with an image forming process. The automatic paper supply mechanism includes a paper supply roller that is rotated, under pressure, in contact with the topmost of the stacked recording media, and that separates and supplies the topmost recording medium. A friction member, located at the contact portion of the supply roller, generates sufficient friction to facilitate the supply of paper. The feeding mechanism includes a feed roller that rotates upon the application of a driving force produced by a drive source; a coupled roller that interacts with the feed roller and sandwiches the recording medium; and a paper path along which the recording medium is conveyed and passed between the rollers.

As is disclosed in Japanese Patent Application Laid-Open No. 11-233803 or No. 11-234697, in a well known conventional image forming apparatus, for multiple mechanisms that are driven by a drive source other than a carriage drive source, the transmission of the force produced by the drive source is changed in accordance with the location of a carriage on which a recording head is mounted. For example, in a configuration wherein the drive source is employed in common by a recovery mechanism and a paper supply mechanism, the driving force output to these mechanisms is switched in accordance with the location of the carriage, or in accordance with whether it is determined, consonant with the location of the carriage, a resisting operation is required at the paper supply mechanism.

Further, in an image forming apparatus disclosed in Japanese Patent Application Laid-Open No. 11-231514, the cap in a recovery system is slid on and off and is opened or closed in accordance with the movement of the carriage.

Furthermore, in the configuration disclosed in Japanese Patent Application Laid-Open No. 11-138782, the wiping, the suction and the paper supply operations for the recovery system are performed using a third drive source that differs from a carriage drive source and a drive source for a recording medium feeding mechanism. In addition, in accordance with the location of the carriage when the recording head is mounted and the rotational direction and distance of the third drive source, the wiping operation and the suction operation are selectively performed by the recovery system, and one of multiple paper supply mechanisms is selected and driven.

However, the conventional configurations described in the publications originally change the drive source in accordance with the movement of the carriage, and therefore, they have the following problems.

According to the configurations disclosed in Japanese Patent Application Laid-Open No. 11-233803 and No. 11-234697, a comparatively complicated mechanism is required to change the drive source, and extra time is required to move the carriage to the switching position and to change the drive source. Further, in accordance with the position of the carriage, the switching position must be located outside the normal carriage movement range, and the size of the main body of the apparatus is increased, particularly in the direction in which the carriage is moved. These problems also apply to the configuration disclosed in Japanese Patent Application Laid-Open No. 11-231514.

In Japanese Patent Application Laid-Open No. 11-138782, since the third drive source is employed in common and is switched for the wiping operation, the suction operation and the paper supply operation, a complicated mechanism is required. Further, problems still exist in the time required for changing operations in accordance with the location of the carriage, and in downsizing and simplification and in cost reduction for the apparatus.

SUMMARY OF THE INVENTION

To resolve the above shortcomings, it is one objective of the present invention to provide an image forming apparatus having a simple configuration that can change a drive source used in common without requiring a switching operation in accordance with the movement of a carriage.

It is another objective of the present invention to provide an image forming apparatus, which employs a recording head to record data on a recording medium, comprising:

- recovery means, for maintaining the recording performance of the recording head;
- a first drive source, for driving feeding means for the recording medium; and
- a second drive source, for driving supply means to supply the recording medium to the feeding means, wherein the first drive source also serves as a drive source for a first drive mechanism, in the recovery means, by using a switching mechanism for changing the transmission of a drive force in accordance with a change in the operating direction of the first drive source, and wherein the second drive source also serves as a drive source for a second drive mechanism, in the recovery means, by using a switching mechanism for changing the transmission of a drive force in accordance with a change in the operating direction of the second drive source.

It is an additional objective of the present invention to provide an image forming apparatus wherein the transmissions of drive forces, produced by the first and the second drive sources, are changed by employing switching mechanisms that change the drive forces in accordance with the operating directions of the respective drive sources, so that the transmission of the drive forces can be changed only by controlling the operating instruction for the drive sources, and at arbitrary timings.

DETAILED DESCRIPTION OF THE PREFERRED EMBODIMENT

The preferred embodiment of the present invention will now be described in detail while referring to the accompanying drawings.

Figure 1:
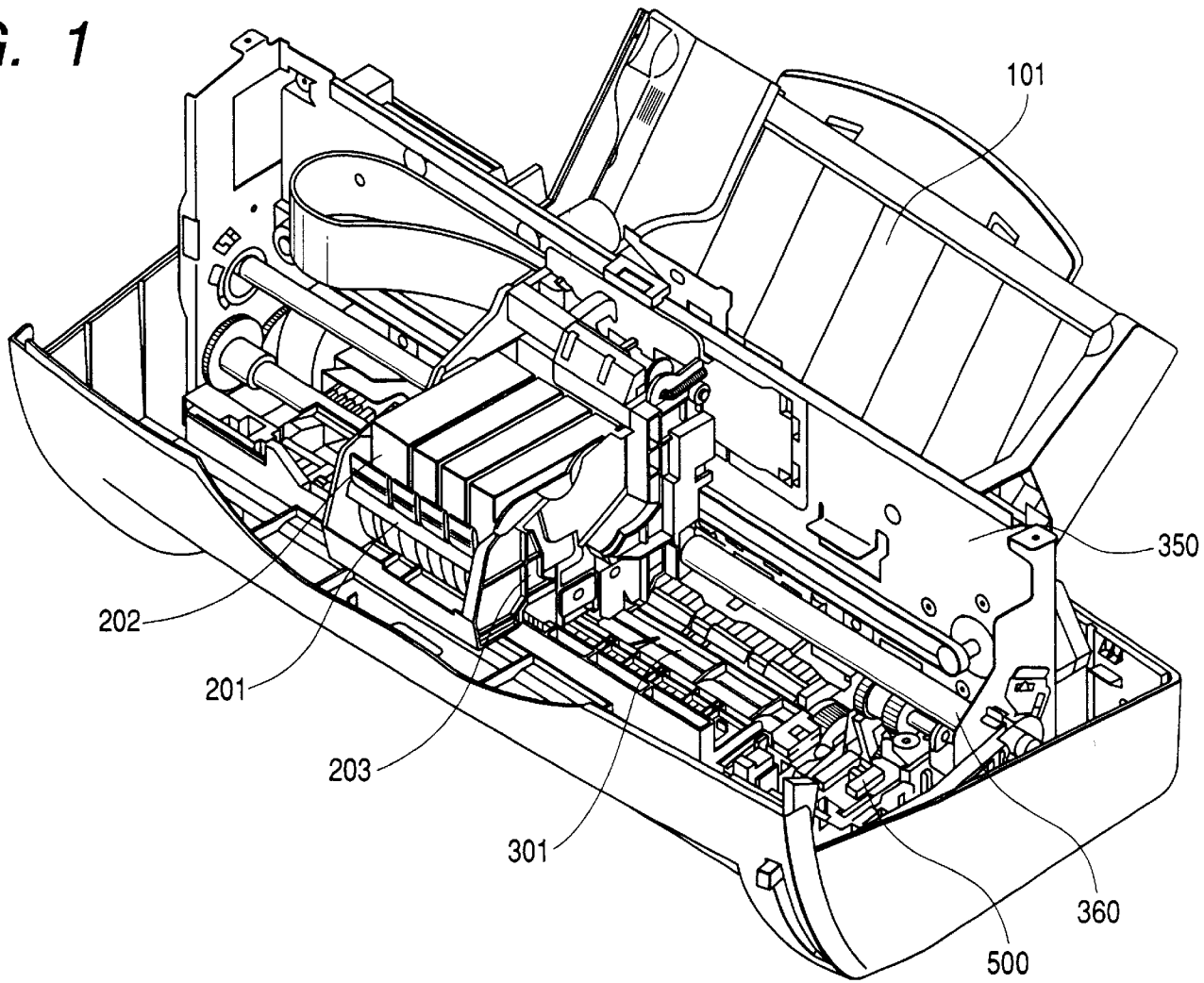
FIG. 1 is an external perspective view of an ink-jet printer according to one embodiment of the present invention.

FIG. 1 is an external perspective view of an ink-jet printer, provided as an example image forming apparatus in accordance with the embodiment of the present invention, with its upper case removed.

In FIG. 1, a sheet (recording medium) set on a paper tray 101 is supplied as paper supply rollers (not shown) are rotated, and is fed across a platen 301 by feed rollers (not shown). While the sheet is being fed, ink is ejected in the scanning direction from multiple recording heads 201 mounted on a carriage 203, and an image, for example, is recorded (formed) on the sheet. The recording heads 201 and ink tanks 202, in which inks are respectively contained, are mounted on or removed from the carriage 203. The carriage 203 is slidably fitted along a scan rail 360, and the recording heads 201 are driven by a driving force, produced by a carriage motor (not shown), that is transmitted via a transmission mechanism, such as a belt.

A recovery mechanism 500 is located at one end of the carriage 203, in the range within which the carriage moves, to perform an ejection and recovery process for maintaining a preferable ejection function for the recording heads 201. Since, as will be described later, a part of the function of the recovery mechanism 500 employs a drive source in common with the paper supply rollers, a switching mechanism is provided for the recovery mechanism 500. Similarly, since the feed rollers employ in common another drive source with a part of the function of the recovery mechanism 500, a switching mechanism is provided for the feed rollers.

As is described above, multiple recording heads 201 and an ink cartridge are attached to or removed from the carriage 203. However, in this embodiment, a cartridge holder in which an ink cartridge is mounted is further attached to a holder integrally provided for the recording heads 201, and the assembled unit is mounted on the carriage 203. The multiple recording heads 201 and the ink tanks 202 correspond to black, cyan, magenta and yellow inks.

The recording head for this embodiment is an ink-jet recording head that uses thermal energy to generate air bubbles in ink, and uses the pressure produced by the air bubbles to eject ink.

Figure 2:
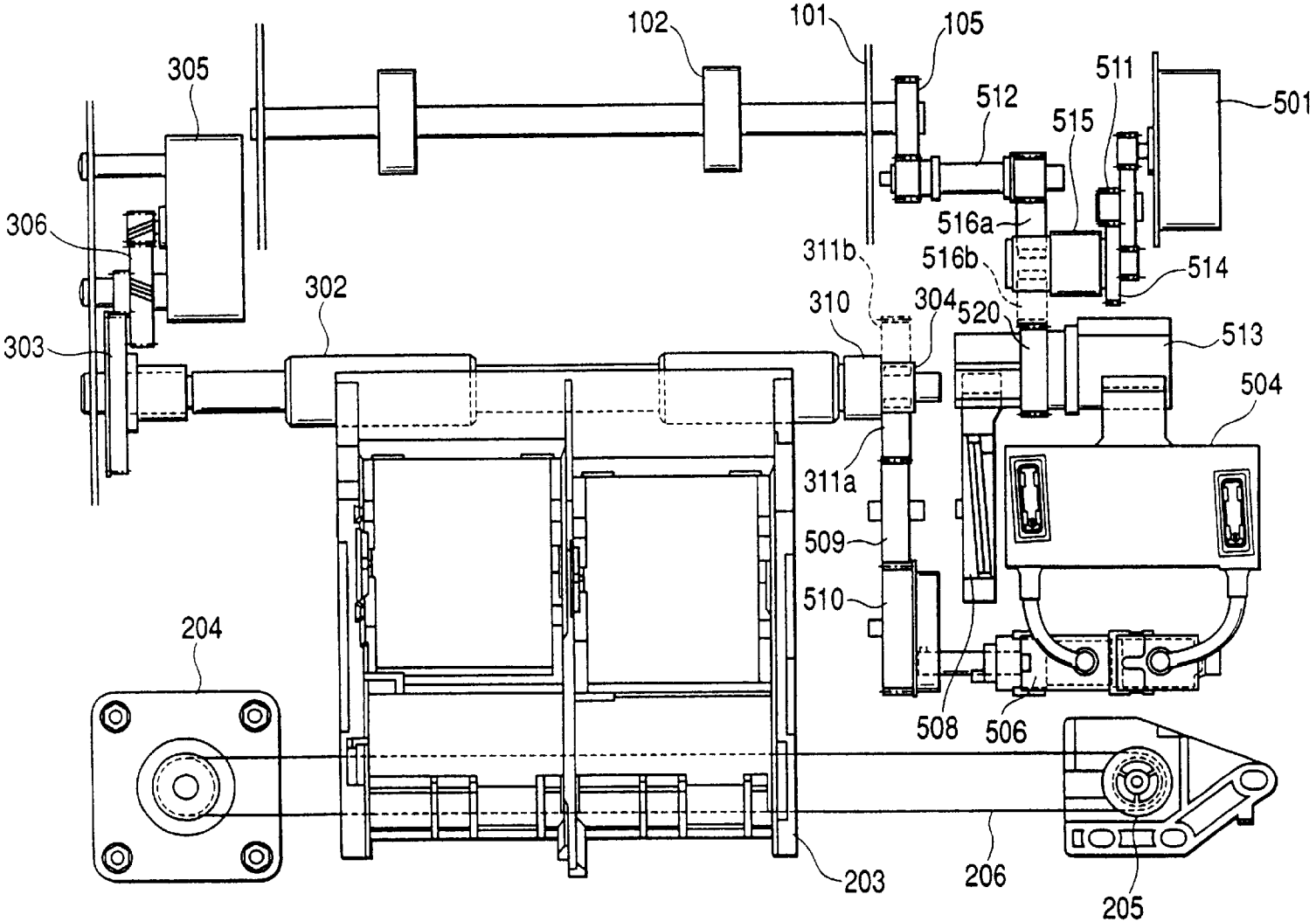
FIG. 2 is a schematic plan view for explaining the transmission of a drive force to each mechanism in the ink-jet printer in FIG. 1.

FIG. 2 is a plan view especially for explaining a drive force transmission arrangement for multiple ink-jet printer drive sources and mechanisms that are driven by the drive sources.

In FIG. 2, a line feed (LF) motor 305 is a first drive source, an Automatic sheet feeding/Purge (AP) motor 501 is a second drive source, and a carriage (CR) motor 204 is a third drive source.

The drive force generated by the rotation of the LF motor 305, which is the first drive source, is transmitted via an LF speed reduction gear 306 and an LF gear 303 to feed rollers 302, to rotate the feed rollers.

An LF pendulum arm 310 is rotatably fitted into a base gear 304 that is attached at the end of the feed roller pair 302. An LF planetary gear 311, which engages the base gear 304, is attached to the LF pendulum arm 310, and as a result, the pendulum gear transmission mechanism (hereinafter referred to as an LF pendulum mechanism) is provided. When a recording medium is normally fed by the rotation of the feed rollers 302, the LF pendulum mechanism is halted at a predetermined position (a position whereat the LF planetary gear 311 is denoted by 311*b* in FIG. 2; see FIGS. 4 and 6) by a specific clutch mechanism, regardless of the rotation of the feed rollers 302. When the feed rollers 302 are rotated in the direction opposite to the normal feeding direction, the LF pendulum mechanism is rotated and reaches a position whereat the LF planetary gear 311 engages a pump transmission gear 509 (the position whereat the LF planetary gear 311 is denoted by 311*a* in FIG. 2), and transmits the drive force exerted by the feed rollers 302 to a pump cam 510 that drives a pump 506. As is described above, the LF pendulum mechanism serves as a one-way driving force transmission mechanism that drives or halts the pump 506.

As is described above, the LF motor 305, the first drive source, transmits a drive force, via the one-way driving force transmission mechanism, to the feed rollers 302 and the pump cam 510.

The AP motor 501, which is the second drive source, serves as a drive source both for the paper supply rollers 102 of the paper supply mechanism, which supplies a recording sheet from the paper tray 101 (see FIG. 1) to the platen 301, and for the cap and the blade of the recovery mechanism 500.

The AP motor 501 is provided as a part of the recovery mechanism 500 in FIG. 1, and the drive force generated by the rotation of the AP motor 501 is transmitted via an AP reduction gear 511 to an AP sun gear 514. An AP pendulum arm 515, as well as the LP pendulum arm 310, are attached to a base gear that is coaxially attached to the AP sun gear 514. That is, the base gear engages an AP planetary gear 516 that is attached to the AP pendulum arm 515, so that the drive force produced by the AP motor 501 can be transmitted to the AP planetary gear 516, and the AP pendulum arm 515 can be rotated in accordance with the rotation of the base gear.

With this arrangement, the AP pendulum arm 515 is rotated in either direction in accordance with the direction in which the AP motor 501 is rotated. Thus, the AP planetary gear 516 reaches a position whereat the gear 516 engages a paper output gear 512 for outputting a drive force to the sheet supply mechanism (the position in FIG. 2 whereat the AP planetary gear 516 is denoted by 516*a*) or the position whereat the gear 516 engages a gear 520 coaxially provided with a cap cam 513 that operates a cap holder 504 and a blade holder 508 in the recovery mechanism 500 (the position in FIG. 2 whereat the AP planetary gear 516 is denoted by 516*b*). As a result, the transmission of the drive force to the sheet supply mechanism or the cap mechanism can be changed. Therefore, the AP pendulum arm 515 and the other components constitute the second pendulum gear transmission mechanism (hereinafter referred to as an AP pendulum mechanism).

When the AP planetary gear 516 engages the paper output gear 512, the drive force of the AP motor 501 is transmitted to the paper supply gear 105. Thus, the paper supply roller 102 is rotated and one of the sheets stacked on the tray 101 is supplied, as is explained while referring to FIG. 1.

When the AP planetary gear 516 engages the gear of the cap cam 513, as the cap cam 513 is being rotated, the cap holder 504 and the blade holder 508 can perform a predetermined operation along the shape of the cam. Thus, the cap holder 504 can be advanced to or retracted from the recording heads, and the blade holder can be advanced into or retracted from the recording head transit area.

The CR motor 204, the third drive source, drives the carriage 203, and as is explained while referring to FIG. 1, displaces the carriage 203, on which the recording heads 201 are mounted, in the main scan direction. The carriage 203 is connected to a CR belt 206 extending from the CR motor 204 to an idle pulley 205. And thus, when the driving force produced by the CR motor 204 is converted, via the CR belt 206, from rotational to linear, the carriage 203 is displaced in the main scan direction.

As is described above, according to the embodiment, the paper supply operation, the feeding operation and the recovery operation can be switched, without depending on the location and the movement of the carriage 203. Therefore, since a complicated switching mechanism and an extra carriage halt location for switching are not required, the size of the apparatus is not increased. And further, since no extra time is required for a carriage switching operation, and since the feed rollers 302, the paper supply roller 102 and the carriage 203 can be driven at appropriate arbitrary timings, optimal paper supply, feeding, main scanning and discharge operations can be performed and the image forming throughput increased.

Figure 3:
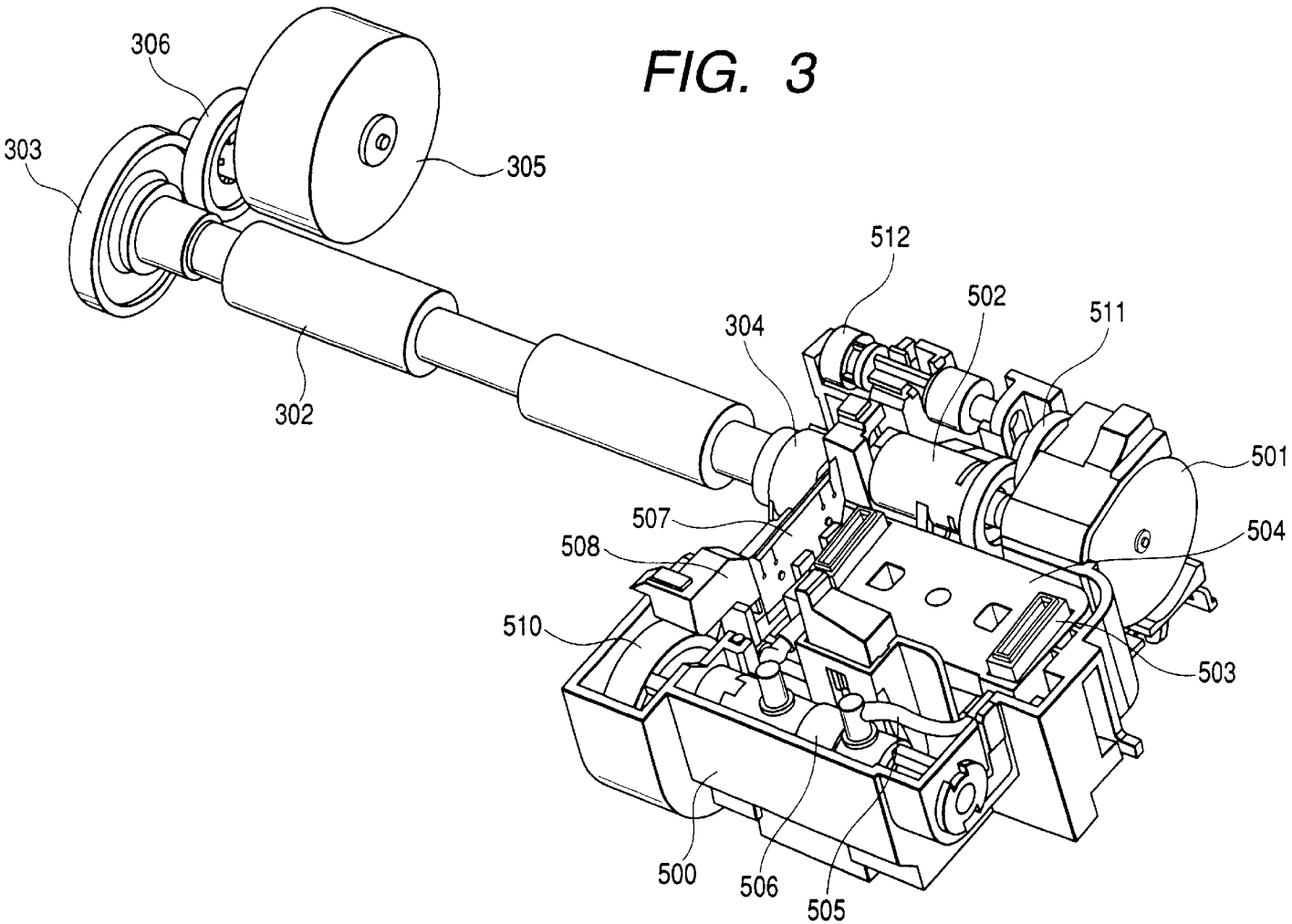
FIG. 3 is a perspective view of a recovery system in the printer in FIG. 1, and a drive source for transmitting a drive force to a recovery mechanism.

FIG. 3 is a detailed perspective view of the configuration of the recovery mechanism 500.

As is shown in FIG. 3, provided for the recovery mechanism 500 are two caps 503, which cover the discharging orifice faces of the recording heads when printing is not in progress and prevent ink in the recording heads from drying or evaporating, and the cap holder 504, which supports the caps 503. With this configuration, the second drive source can perform, as a capping operation, the capping and uncapping of the discharging orifice faces of the two recording heads. The caps 503, which communicate with the pump 506 via the cap holder 504 and a joint tube 505, and the drive force produced by the LF motor, which is the first drive source, can be utilized to perform a suction operation while a blade 507 and its supporting blade holder 508, impelled by the drive force produced by the AP motor 501, the second drive source, perform a wiping operation to remove ink from the recording heads.

Figure 4:
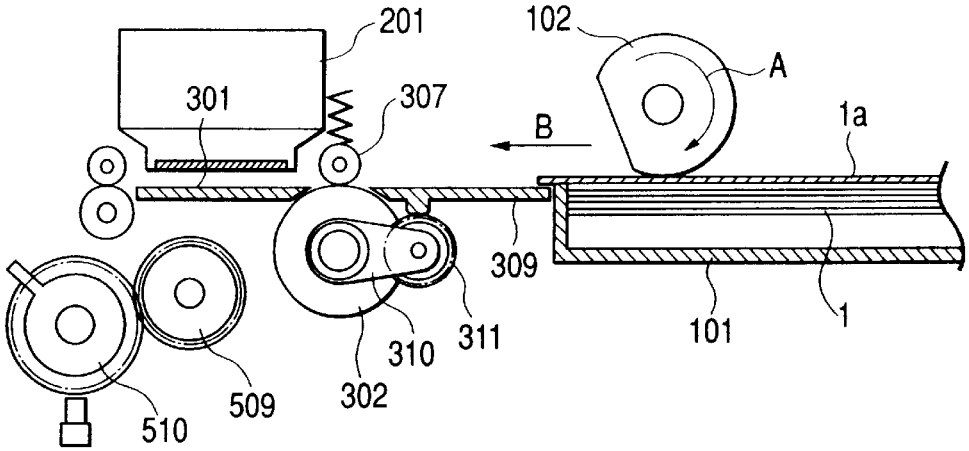
FIG. 4 is a side view for explaining the paper supply sequence for the ink-jet printer in FIG. 1.
Figure 5:
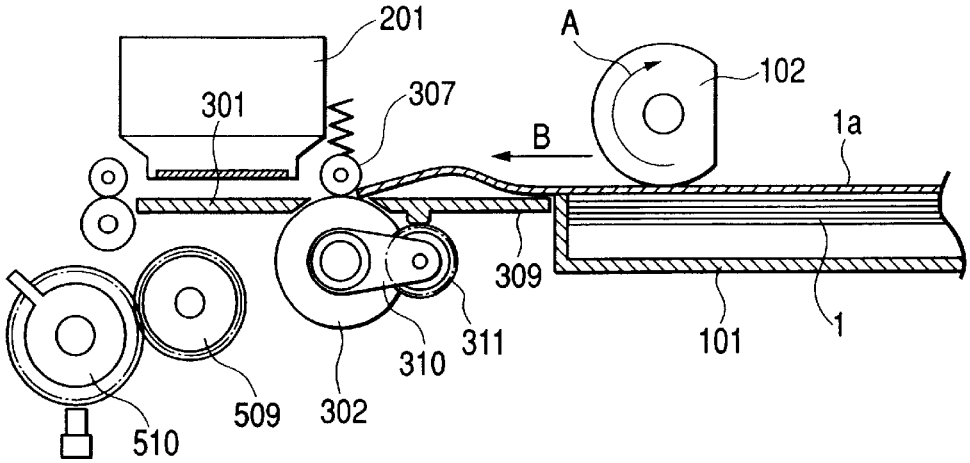
FIG. 5 is a side view for explaining the paper supply sequence for the ink-jet printer in FIG. 1.
Figure 6:
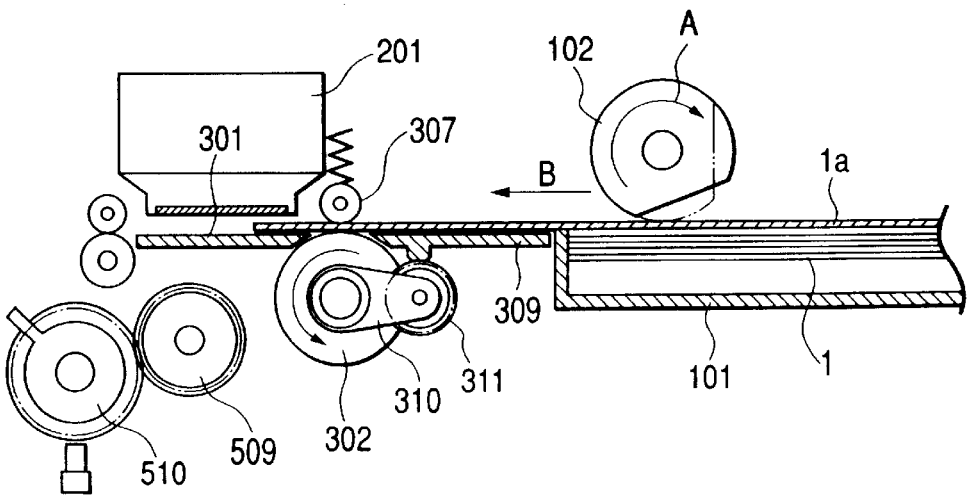
FIG. 6 is a side view for explaining the paper supply sequence for the ink-jet printer in FIG. 1.

FIGS. 4 to 6 are side views for explaining the paper supply sequence performed by the automatic paper supply mechanism.

In FIGS. 4 to 6, multiple recording sheets 1, recording media, are stacked and stored on the paper tray 101. The paper supply rollers 102, for which a friction member is provided, include an arched portion that contacts a topmost sheet 1*a* and applies a supply force to the sheet 1*a*, and a non-contact portion that at the initial position does not contact the sheet 1*a*. The supply rollers 102, which as a whole are D-shaped in cross section, are driven separately from the feed rollers 302 or the carriage 203. It should be noted that a paper supply roller position detector (not shown) is provided that indicates whether the supply rollers 102 are at the initial position, whereat their non-contact portions face the sheet 1*a* and they do not contact the sheets 1.

When the paper supply rollers 102 begin to rotate in the direction indicated by an arrow A in FIG. 4, the sheets 1 and the paper supply rollers 102 are pressed against each other, and the force of the friction supplied by the paper supply rollers 102 is utilized to feed the topmost sheet 1*a* in the direction indicated by an arrow B in FIG. 4. The topmost sheet 1*a* is then guided along a paper pan 309 to the feed rollers 302.

At this time, as is shown in FIG. 5, since the feed rollers 302 are halted, the topmost sheet 1*a* abuts against the nip portion between the feed roller 302 and the coupled roller 307 and forms an adequately sized loop, so that the sheet feeding position alignment (resistance removal) is performed.

Following this, as is shown in FIG. 6, as the feed rollers 302 are rotated in the direction indicated by the arrow, the topmost sheet 1*a*, abutting upon the nip portion, is fed to the recording location on the platen 301, which faces the recording heads 201. At this time, the paper supply rollers 102 are synchronously rotated in the direction indicated by the arrow A and are reset in the initial position. When the topmost sheet 1*a* has reached the recording position and the paper supply rollers 102 have been reset in the initial position, the paper supply operation is completed and the recording process, using the recording heads 201, is initiated.

While at the recording time the feed rollers are rotated to feed the sheets 1, as is evident from FIG. 6, the LF pendulum mechanism, which is provided for the feed rollers 302 and which is constituted by the LF pendulum arm 310 and the LF pendulum gear 311, is rotated in the direction opposite to the direction in which the pump transmission gear 509 is engaged, as is described above. Therefore, no drive force is transmitted to the pump transmission gear 509 and the pump cam 510.

Figure 7:
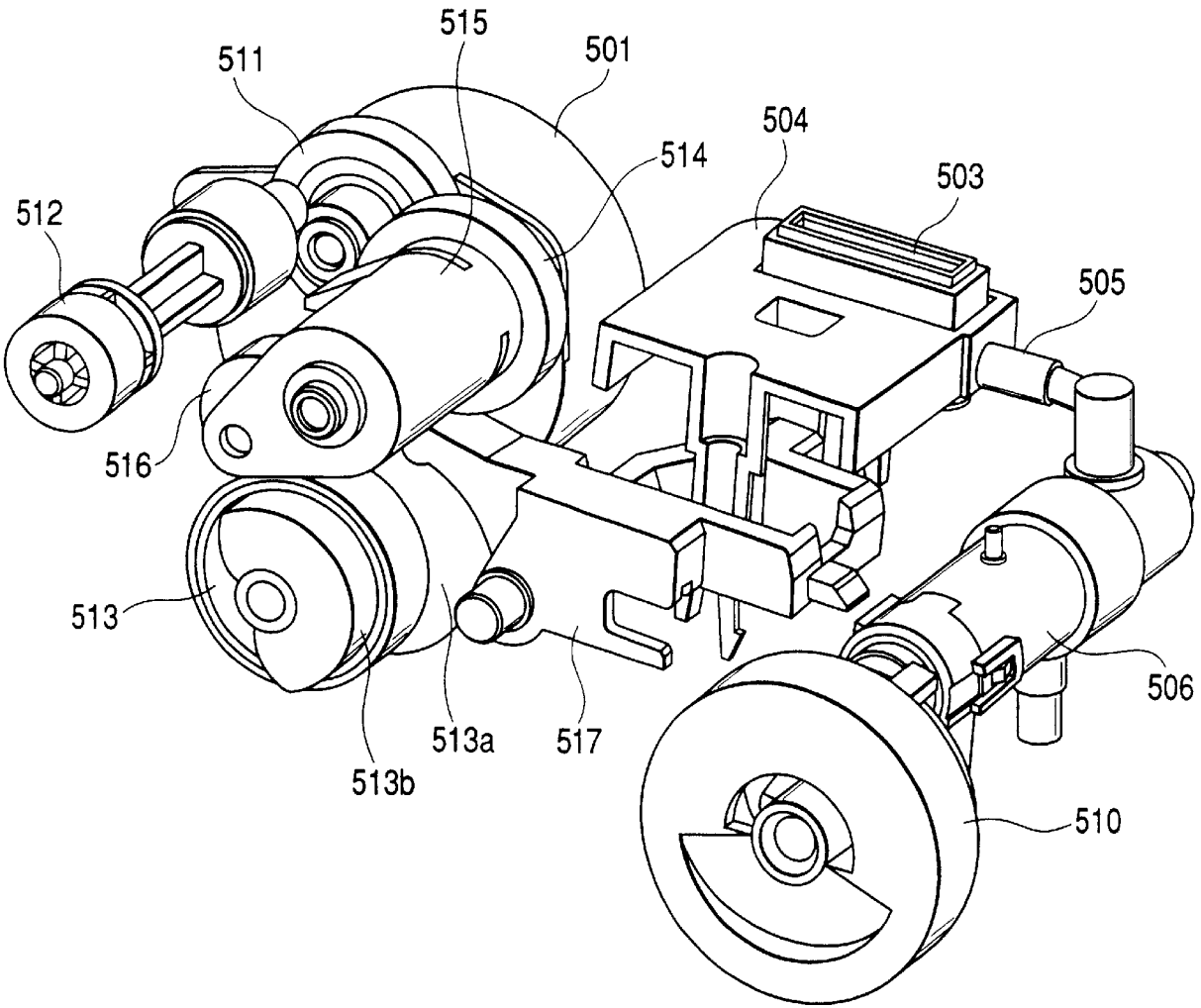
FIG. 7 is a perspective view for explaining the capping arrangement for the recovery mechanism in FIG. 3.

FIG. 7 is a perspective view for explaining the detailed structure of the cap in the recovery mechanism 500.

In FIG. 7, as is described above, the drive force generated by the rotation of the AP motor 501 is transmitted, via the pendulum arm 515 of the AP pendulum mechanism, to the paper output gear 512 or the gear for the cap cam 513, and the corresponding mechanism is driven. The driving by the AP pendulum mechanism can be arbitrarily selected by changing the rotational direction of the AP motor 501.

In FIG. 7 is shown the state wherein the drive force is transmitted to the cap cam 513. When the drive force is transmitted to the cap cam 513, a cap lever 517 is pivoted at a predetermined fulcrum along the cam shape of a cap driving cam 513*a* provided for the cap cam 513. Then, the cap holder 504, which engages the cap lever 517, is driven and covers the recording heads 201 with the caps 503 or removes the caps 503 therefrom.

Since the cap holder 504 and the pump 506 are coupled with the joint rubber 505, the pump 506 is driven when the caps 503 are mounted on the recording heads 201, and establishes a vacuum that removes ink from the recording heads 201.

As is described above, the pump 506 is driven when the force produced by the rotation, in the direction opposite to the feeding direction, of the LF motor 305, the first drive source, is transmitted to the pump cam 510.

Figure 8:
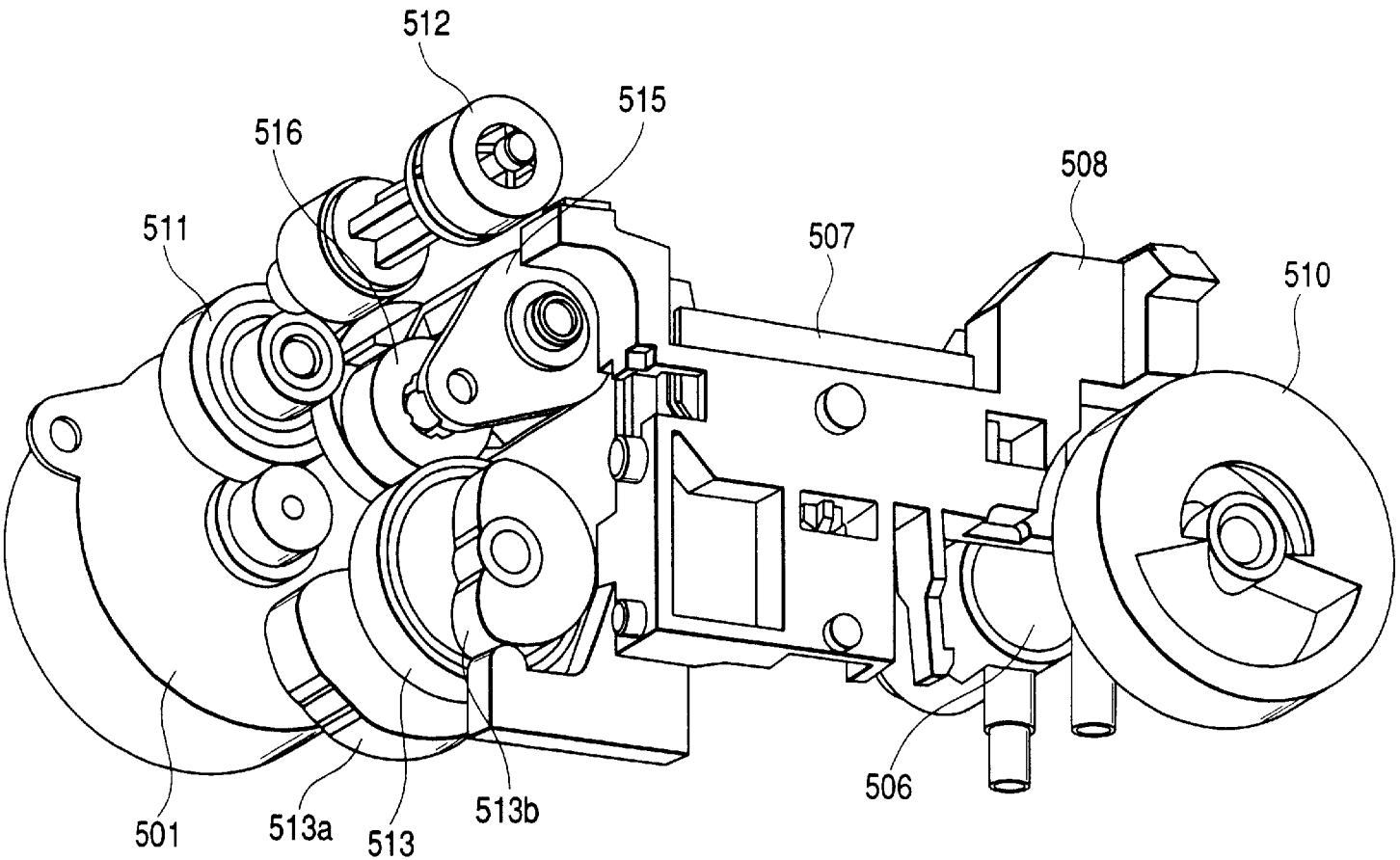
FIG. 8 is a perspective view for explaining the arrangement of the wiping means in the recovery mechanism in FIG. 3.

FIG. 8 is a perspective view for explaining the wiping configuration of the recovery mechanism 500.

In FIG. 8, as well as in FIG. 7, when the cap cam 513 is rotated by the drive force produced by the AP motor 501, the blade holder 508 is displaced vertically along the cap shape of the blade driving cam 513*b* provided for the cap cam 513. Thus, the blade 507 can be advanced into or removed from the recording head transit area.

As is described above, the cap drive cam 513*a* and the blade drive cam 513*b* are provided for the cap cam 513. The cap is so shaped that during one rotation of the cap cam 5123, the caps 503 and the blade 507 are set at three positions: the state where the caps 503 and the blade 507 have been removed from the recording head 201 (or the recording head transit area), the state where the caps 503 cover the recording heads 201 and the blade 507 has been retracted from the recording head transit area, and the state where the blade 507 is present in the recording head transit area and the caps 503 have been retracted.

With this configuration, the operations of the individual mechanisms in the recovery process sequence will now be described.

FIGS. 9 to 13 are cross-sectional views for explaining the processing sequence employed to recover the recording head.

Figure 9:
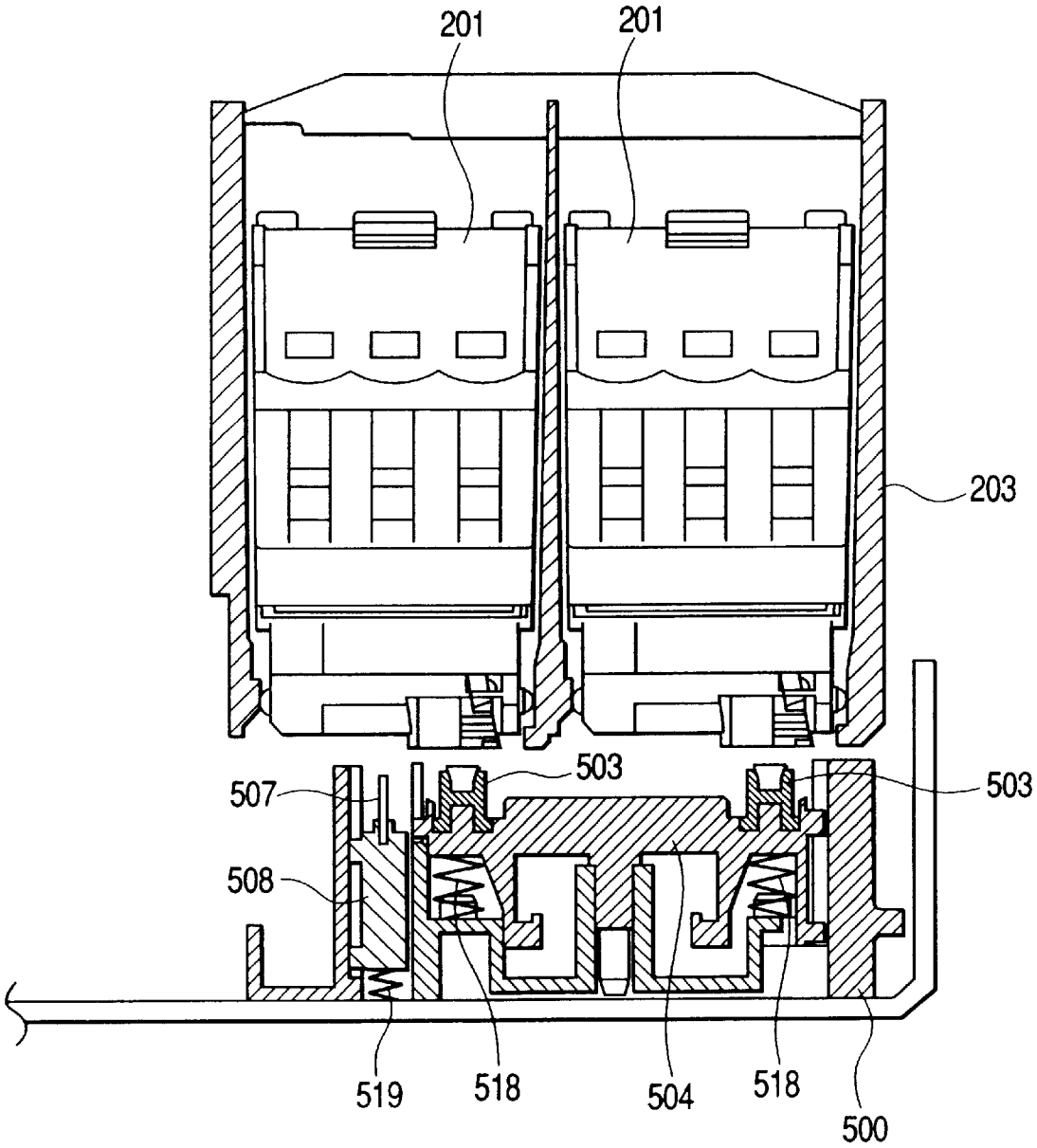
FIG. 9 is a cross-sectional view for explaining the processing sequence performed for the recovery of the thus arranged recording head.

In FIG. 9 is shown the state wherein the caps 503 and the blade 507 are positioned apart from the recording heads 201, and have no affect on the movement of the carriage 203. That is, during normal recording, the state of the recovery mechanism 500 is as shown in FIG. 9. Therefore, the position whereat the carriage 203 begins to move in the main scanning direction can be defined as the position in FIG. 9 where the recording heads 201 and the caps 503 are opposite each other, and an extra carriage position for switching, for example, need not be set outside the carriage movement start position.

Figure 10:
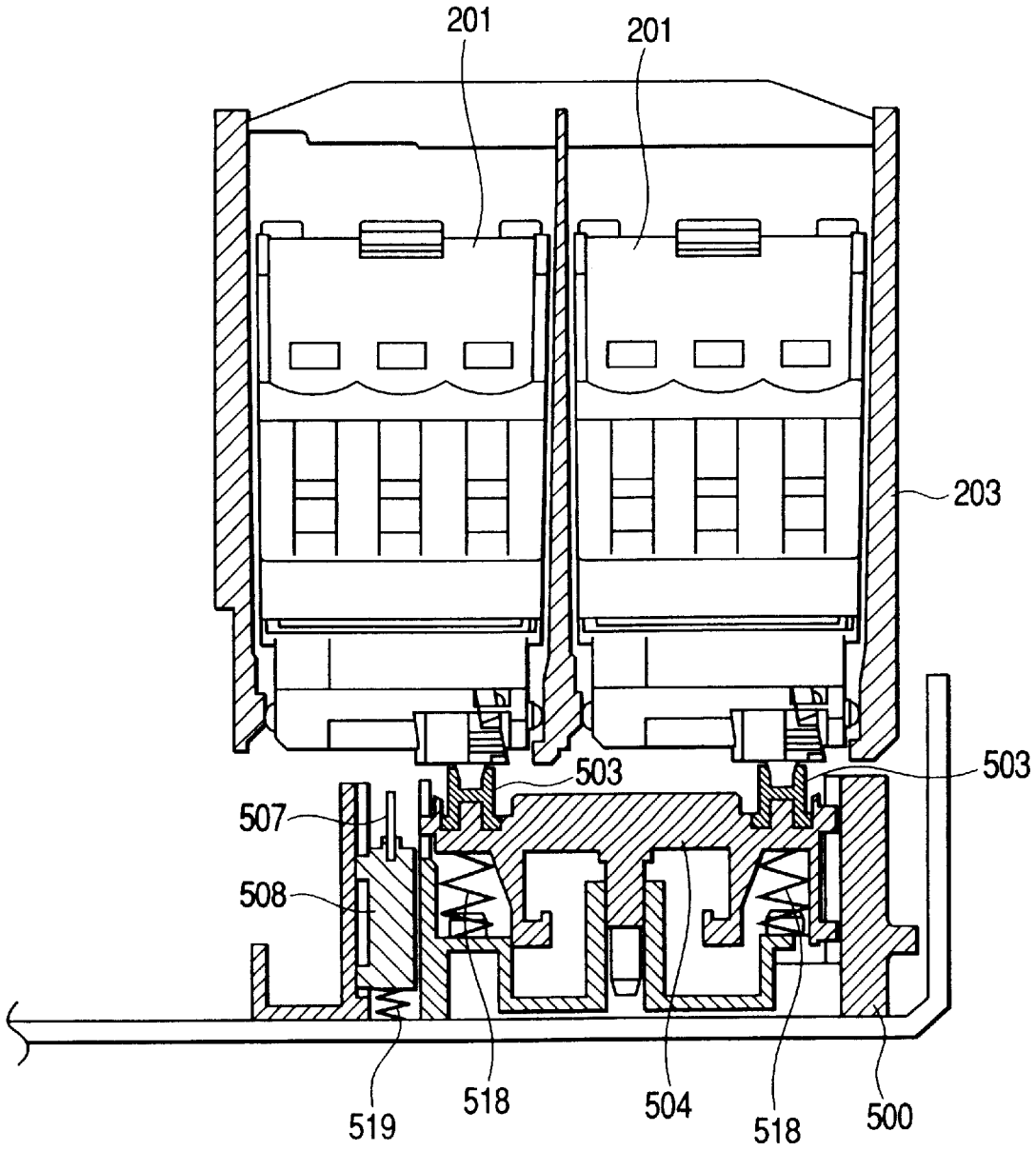
FIG. 10 is a cross-sectional view for explaining the processing sequence performed for the recovery of the thus arranged recording head.

In FIG. 10 a so-called capping state is shown wherein the caps 503 contact the recording heads 201 on the carriage 203, which have been displaced and positioned opposite the caps 503.

That is, when the cap cam (see FIG. 7) is pivoted, the caps 503, driven by the force exerted by cap springs 518 on the cap holder 504, contact the opposite recording heads 201. As a result, as is described above, ink can be removed from the recording heads 201 by driving the pump 506 (see FIG. 7). It should be noted that the state shown in FIG. 10 is maintained during a normal waiting (non-recording time) time in order to prevent the ink ejecting portions of the recording heads 201 from drying.

Figure 11:
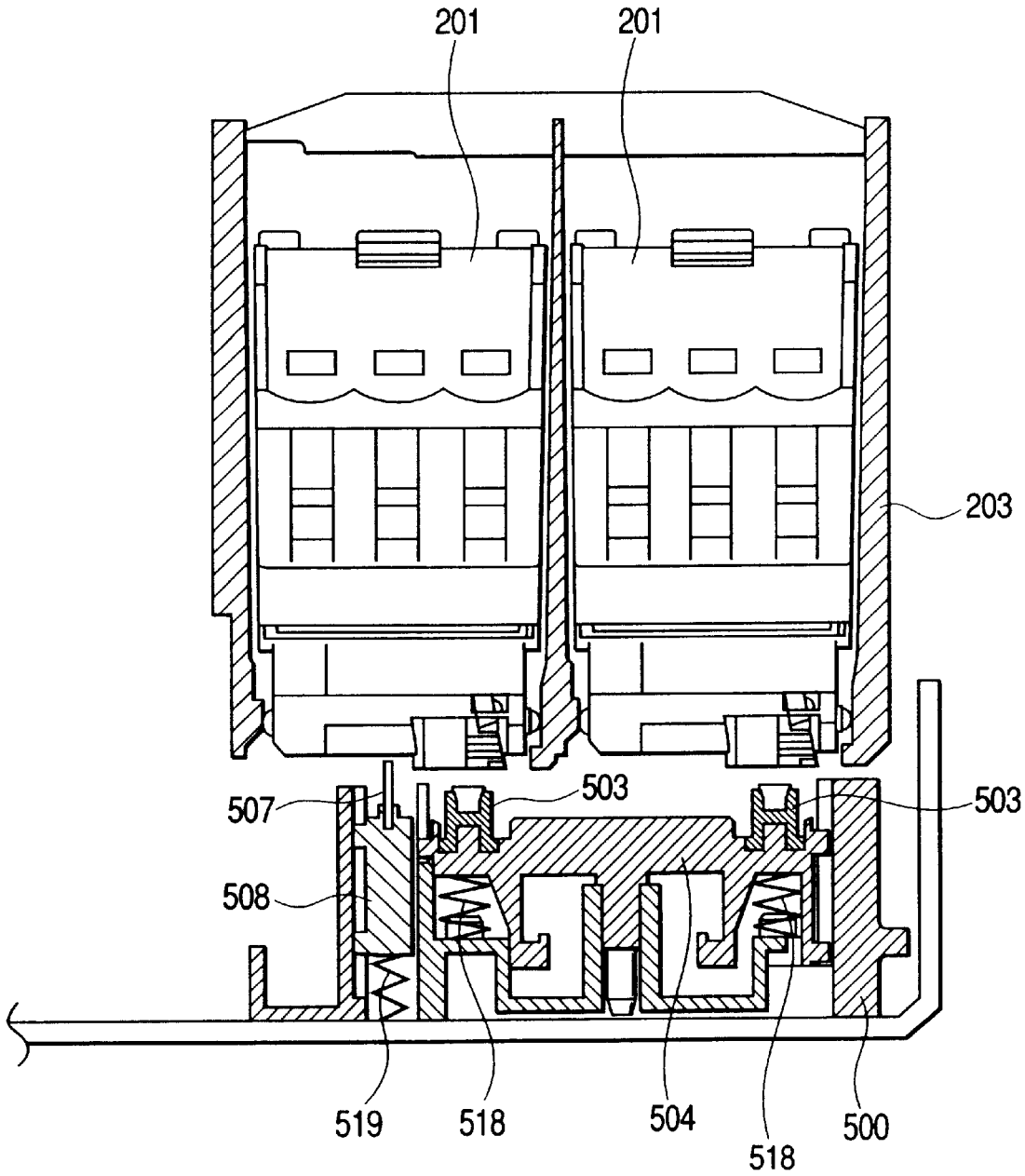
FIG. 11 is a cross-sectional view for explaining the processing sequence performed for the recovery of the thus arranged recording head.

When the cap cam (see FIG. 7) is pivoted further from the state in FIG. 10, and the caps 503 are retracted, the blade 507 is advanced to a position whereat it contacts the recording heads 201, and a wiping ready state, as shown in FIG. 11, is obtained.

After ink has been removed in the state shown in FIG. 10, the pump (see FIG. 7) is again driven in the state shown in FIG. 11 to perform a so-called idle suction operation to discharge ink remaining in the caps 503 and the pump 506 to a location outside the recovery system.

As is described above, the drive source for driving the caps 503 is the AP motor 501 and the drive source for driving the pump 506 is the LF motor 305, and the two drive sources can be independently operated at arbitrary timings. Therefore, for the above idle suction operation, the pump 506 can be driven while the distance between the cap 503 and the recording head 201 is adjusted. Specifically, it is known that the ink attached to the discharging orifice face of the recording head 201 in the vicinity of the orifices can be removed easily when at the time suction is initiated a slight gap is maintained between the recording head 201 and the caps 503. Therefore, a first idle suction operation is performed when the cap 503 is slightly separated from the recording head 201, and a second idle suction operation is performed when the cap 503 is fully separated from the recording head 201. Thus, ink, including ink attached to the recording head 201, can be effectively discharged.

Further, it is possible, while the pump 506 is driven, for the cap 503 to be gradually separated from the recording head 201, or for the distance between the cap 503 and the recording head 201 to be set at multiple levels. Even in an image processing apparatus wherein the distance between the recording head 201 and a sheet (paper distance) fluctuates, suction for removing ink can be applied while an appropriate minute distance is maintained between the recording head 201 and the cap 503.

Figure 12:
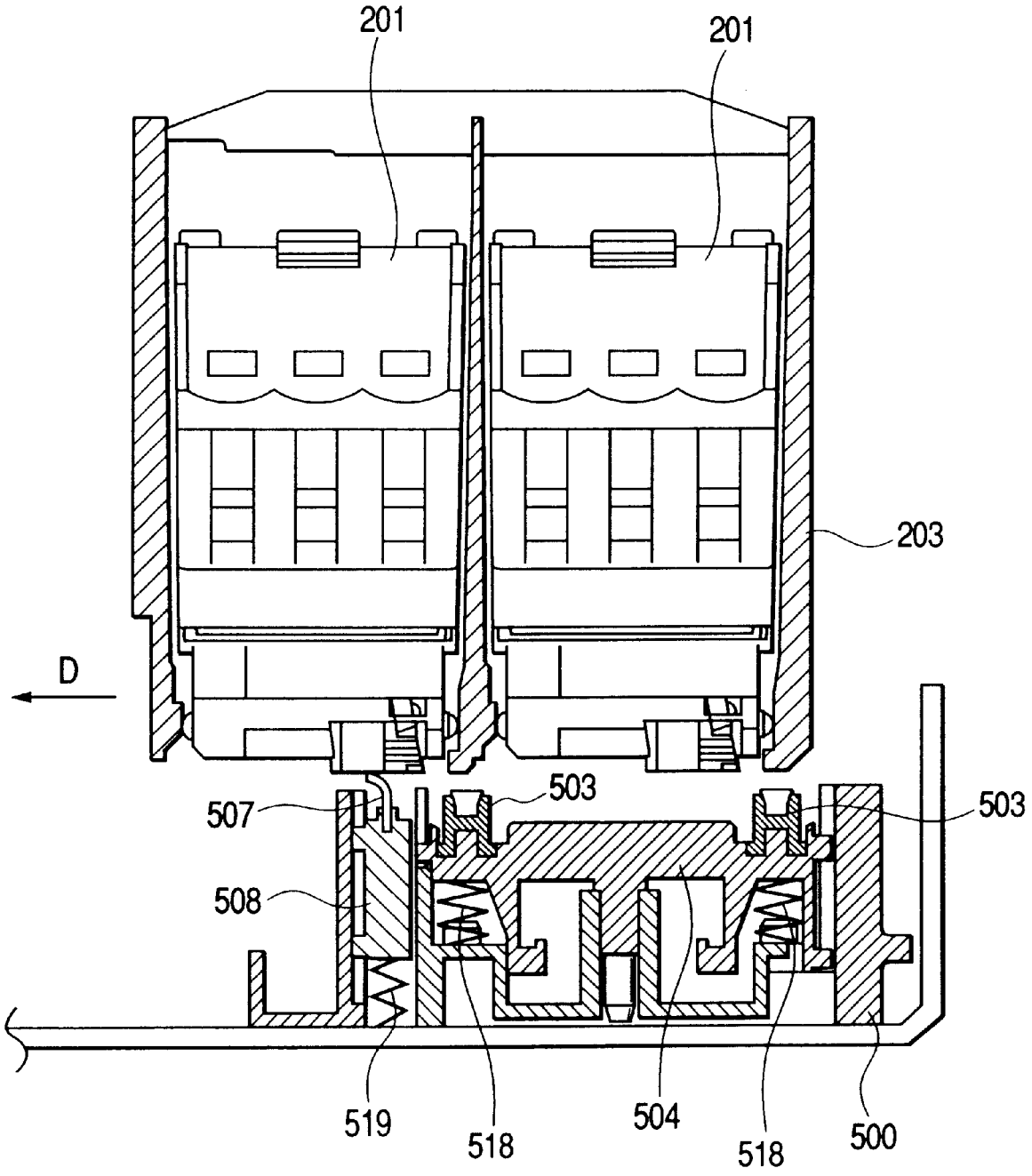
FIG. 12 is a cross-sectional view for explaining the processing sequence performed for the recovery of the thus arranged recording head.

FIG. 12 is a side view showing the wiping operation for the recording head 201.

When the recovery mechanism 500 is in the state shown in FIG. 11, the carriage 203 is moved in the direction indicated by an arrow D in FIG. 12. Then, the blade 507 of the blade holder 508, driven by the blade spring 519, wipes the discharging orifice face of the recording heads 201 and removes the ink and dust that are attached to the discharging orifice face of the recording head.

In this case, as is described above, the blade holder 508 is driven by the drive force supplied by the AP motor 501 and brings the blade 507 into contact with a recording head 201. At this time, the drive force produced by the CR motor 204, the third drive source, and an operation triggered by the movement of the carriage 203 are not required.

Figure 13:
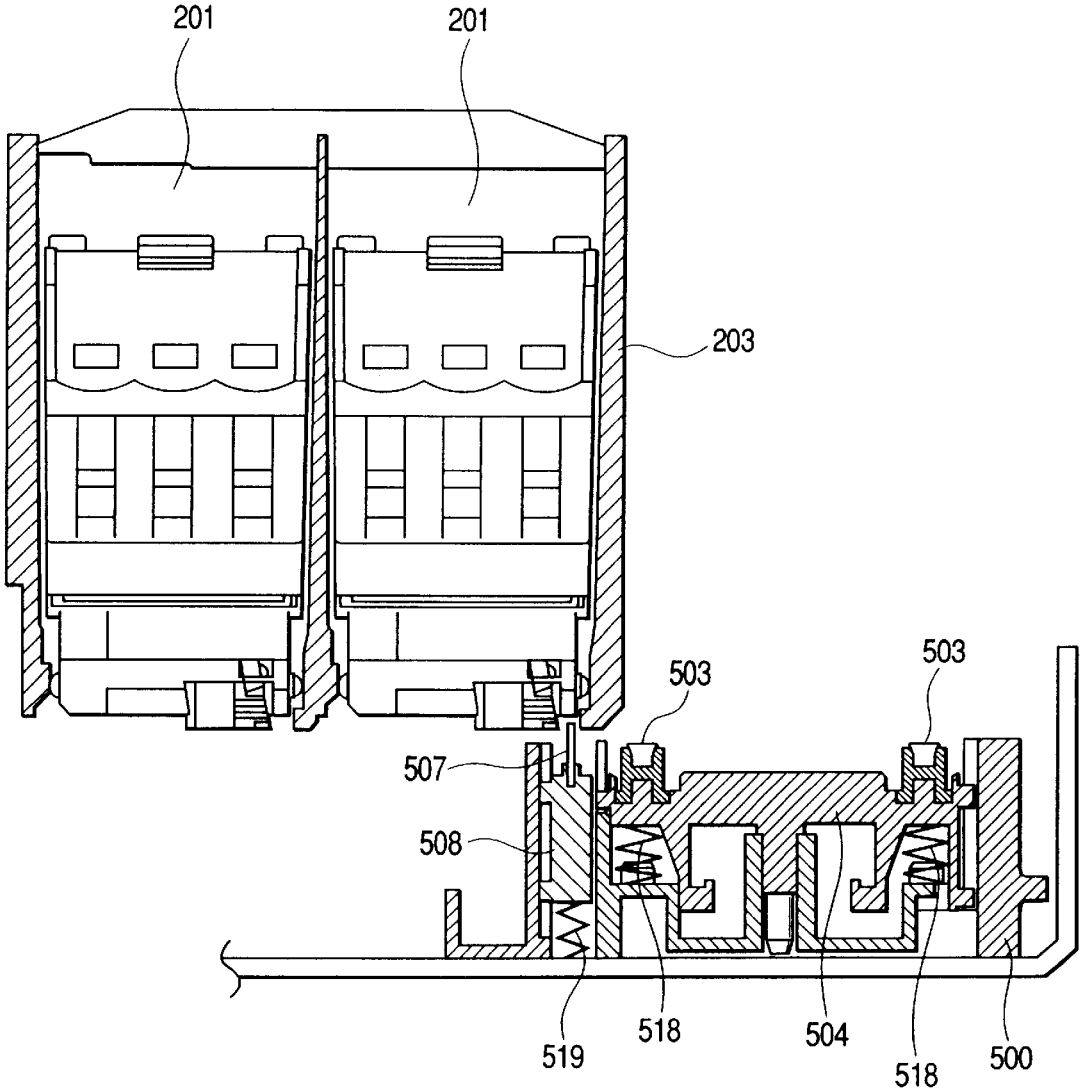
FIG. 13 is a cross-sectional view for explaining the processing sequence performed for the recovery of the thus arranged recording head.

FIG. 13 is a diagram showing the state wherein the wiping of the recording head has been completed.

The wiping is terminated when the carriage 203 has been moved to a position where all the recording heads 201 have passed across and no longer contact the blade 507. At this time, when the cap cam is rotated again, the blade holder 508 is positioned apart from the recording heads 201, and the recording heads 201 are returned to their normal recording ready state. As is described above, the blade holder 508 can be driven at an arbitrary timing, without depending on the movement and the position of the carriage 203.

As is explained above, according to the embodiment, the transmission of the drive forces of the first and the second drive sources can be changed by the respective switching mechanisms in accordance with the operating instructions for the two drive sources. Thus, the transmission of the drive forces can be changed merely by controlling the operating instructions for the drive sources, and at arbitrary timings.

As a result, the transmission of the drive forces can be changed arbitrarily, without the movement or positioning of the carriage being used as a trigger. Thus, the movement of the carriage into an extra range and a complicated switching mechanism are not required, and downsizing, simplification and cost reduction can be implemented for the apparatus.

What is claimed is:

1. An image forming apparatus, which employs a recording head to record data on a recording medium, comprising:

recovery means for maintaining recording performance of said recording head;

a first drive source for driving feeding means for the recording medium; and a second drive source for driving supply means for supplying the recording medium to said feeding means, wherein said first drive source also serves as a drive source for a first drive mechanism in said recovery means by using a switching mechanism for changing a transmission of a drive force in accordance with a change in an operating direction of said first drive source, and wherein said second drive source also serves as a drive source for a second drive mechanism in said recovery means by using a switching mechanism for changing a transmission of a drive force in accordance with a change in an operating direction of said second drive source.

2. An image forming apparatus according to claim 1, further comprising:

a third drive source for scanning said recording head, wherein the switching mechanisms for said first and said second drive sources are operated independently of the scanning of said recording head by said third drive source.

3. An image forming apparatus according to claim 1, wherein said first and said second drive sources have at least two driving modes that can be arbitrarily switched by said switching mechanisms, respectively, and wherein said feeding means is driven in a first driving mode of said first drive source, said first drive mechanism of said recovery means is driven in a second driving mode of said first drive source, said supply means is driven in a first driving mode of said second drive source, and said second drive mechanism of said recovery means is driven in a second driving mode of said second drive source.

4. An image forming apparatus according to claim 3, wherein said first and said second drive sources are motors, and wherein the first and said second driving modes of said first and said second drive sources are operations using forward rotation and reverse rotation of said motors.

5. An image forming apparatus according to one of claims 1 to 4, wherein said recording head is an ink-jet recording head for ejecting ink, and wherein said first drive mechanism of said recovery means is a pump for suctioning ink out of discharging orifices of said recording head, and said second drive mechanism of said recovery means is a capping mechanism for covering said discharging orifices of said recording head or a wiping mechanism for wiping said discharging orifices of said recording head.

6. An image forming apparatus according to claim 5, wherein said pump is driven at an arbitrary timing during operation of said capping mechanism.

7. An image forming apparatus according to claim 5, wherein said recording head is an ink-jet recording head that uses thermal energy to eject ink.

* * * * *